US008197156B2

(12) United States Patent
Morgan et al.

(10) Patent No.: US 8,197,156 B2
(45) Date of Patent: Jun. 12, 2012

(54) SHALLOW MOUNTED FIXED VEHICLE BARRIER DEVICE

(76) Inventors: Mitch Morgan, Gainesville, GA (US); Ilan Lindenboim, Roswell, GA (US)

( * ) Notice: Subject to any disclaimer, the term of this patent is extended or adjusted under 35 U.S.C. 154(b) by 0 days.

(21) Appl. No.: 13/048,404

(22) Filed: Mar. 15, 2011

(65) Prior Publication Data

US 2011/0164921 A1 Jul. 7, 2011

Related U.S. Application Data

(63) Continuation of application No. 11/550,168, filed on Oct. 17, 2006, now abandoned.

(60) Provisional application No. 60/728,154, filed on Oct. 18, 2005.

(51) Int. Cl.
*E01F 13/00* (2006.01)
*E01F 15/00* (2006.01)

(52) U.S. Cl. ..... 404/6; 404/9; 256/13.1

(58) Field of Classification Search ..... 404/6, 9–11
See application file for complete search history.

(56) References Cited

U.S. PATENT DOCUMENTS 1,449,518 A * 3/1923 Lawson ..... 256/13.1
1,903,869 A * 4/1933 Meister et al. ..... 40/608
4,861,185 A * 8/1989 Eikelenboon ..... 404/6
5,228,237 A * 7/1993 Nasatka ..... 49/49
6,141,928 A * 11/2000 Platt ..... 52/296
6,702,512 B1 * 3/2004 Reale ..... 404/6
7,101,112 B2 * 9/2006 Burns et al. ..... 404/6
7,448,169 B2 * 11/2008 Maliszewski et al. ..... 52/79.1
7,607,856 B2 * 10/2009 Patel ..... 404/6
7,699,558 B2 * 4/2010 Adler et al. ..... 404/6
7,775,738 B2 * 8/2010 Darcy ..... 404/6
2004/0033106 A1 * 2/2004 Turpin et al. ..... 404/6
2005/0072115 A1 * 4/2005 Chappell et al. ..... 52/782.1
2005/0220536 A1 * 10/2005 Blair et al. ..... 404/6
2006/0078378 A1 * 4/2006 Burns et al. ..... 404/6
2006/0090408 A1 * 5/2006 Darcy ..... 52/174
2008/0063470 A1 * 3/2008 Bousson et al. ..... 404/6
2008/0232902 A1 * 9/2008 Burns et al. ..... 404/6
2009/0035061 A1 * 2/2009 Crawford et al. ..... 404/6
2009/0208285 A1 * 8/2009 Adler et al. ..... 404/6
2010/0322707 A1 * 12/2010 Darcy ..... 404/6
2011/0033232 A1 * 2/2011 Adler et al. ..... 404/6

* cited by examiner

*Primary Examiner* — Raymond W Addie
(74) *Attorney, Agent, or Firm* — Hope Baldauff Hartman, LLC

(57) ABSTRACT

A shallow mounted fixed vehicle barrier device for prohibiting vehicular access to a facility or area. The shallow mounted fixed vehicle barrier device includes a barrier system having a passive position and a support system adapted to maintain the barrier system in the passive position. In the passive position, the barrier system prevents vehicles from passing by or through to the protected facility or area. The shallow mounted fixed vehicle barrier device always remains in the passive position and, therefore, never allows vehicles access to the secured facility or area, after installation. The barrier system includes a bollard and, optionally, a bollard sleeve. The support system includes a base frame attached to the bollard, such that the base frame is adapted to secure the bollard during vehicular attack. The shallow mounted fixed vehicle barrier device can be installed in a foundation having a depth of less than twelve inches.

16 Claims, 5 Drawing Sheets

SHALLOW MOUNTED FIXED VEHICLE BARRIER DEVICE

CROSS REFERENCE TO RELATED APPLICATION

This application is a continuation of U.S. patent application Ser. No. 11/550,168, filed 17 Oct. 2006, which claims priority of U.S. Provisional Patent Application No. 60/728,154, filed 18 Oct. 2005, the entire contents of which are hereby incorporated by reference.

TECHNICAL FIELD

The present invention relates generally to a fixed vehicle barrier device, and in particular to a fixed vehicle barrier device known as a bollard, which can be mounted in a less than twelve inch foundation.

BACKGROUND OF THE INVENTION

In recent years there has been a dramatic increase in the incidence of attacks on facilities and buildings by terrorists, other aggressors such as extremists, and even disgruntled employees throughout the world. Many of these attacks are directed against government facilities or other high profile locations. One of the most effective means of facility destruction is through the use of a vehicle carrying explosives. To successfully guard against such attacks a standoff distance must be created around the facility. This can be accomplished by the use of a combination of active and passive barriers.

Passive barriers "never" allow vehicular access to certain areas, while active barriers are utilized to control or limit vehicular access to a particular area. Passive barriers often utilize fixed bollards and are used as security barriers to prevent vehicular access to the perimeter of a facility, outdoor public areas, campuses, or any other area where it may be desirable to prevent vehicular traffic.

Since the Sep. 11, 2000 attacks on the United States, a significant number of facilities are seeking passive barrier solutions. The owners of such facilities, as well as the architectural design community, are demanding a passive barrier solution that is easier to install and that provides greater flexibility in installation.

One concern with current fixed bollard barrier art is the need to dig a relatively deep foundation, typically four to six feet, for the installation of the barrier. This depth of foundation is required to make the barrier robust enough to meet the Department of State (DOS) crash testing requirements for a 15,000 pound vehicle. Non-crash rated barriers do not require this depth of foundation. Many city sidewalks and other desirable locations have various infrastructure (such as pipes and wiring) or other building structures located eighteen inches or more below the surface that would prevent the installation of "crash rated" bollards.

Another problem of concern comes from current fixed bollard barriers that have tried to address the foundation depth issue by building several bollards together into a very large bollard assembly. These large bollard assemblies require extensive site surveying and detailed design engineering to allow the pre-designed bollard assembly to perfectly match the contour of the surface. In the end this is a virtually impossible task and extremely expensive.

What is needed is a fixed vehicle barrier device that can be mounted in a shallow foundation, while still providing adequate protection from attack. Further, what is needed is a fixed vehicle barrier device that can be individually installed in groups without extensive site surveying and detailed design engineering, while still meeting the DOS crash rating requirements. It is to such a device that the present invention is primarily directed.

BRIEF SUMMARY OF THE INVENTION

Briefly described, in preferred form, the present invention is a shallow mounted fixed vehicle barrier device for prohibiting vehicular access to a facility or area. The shallow mounted fixed vehicle barrier device includes a barrier system having a passive position and a support system adapted to maintain the barrier system in the passive position. In the passive position, the barrier system prevents vehicles from passing by or through to the protected facility or area. More specifically, the shallow mounted fixed vehicle barrier device always remains in the passive position and, therefore, never allows vehicles access to the secured facility or area.

The barrier system can include a bollard and, optionally, a bollard sleeve. The bollard generally stands a significant height above, and substantially perpendicular to, a foundation, thereby preventing vehicular access. The bollard is in communication with the support system, which is typically anchored within the foundation. The bollard sleeve can be a decorative sleeve that substantially surrounds the bollard, such that the bollard sleeve allows the bollard to be decoratively customized to match the architectural setting of the area or facility.

The support system can include a base frame anchored to the foundation via the use of concrete or other similar pavement substance. The base frame is in communication with the bollard and is adapted to secure and support the bollard, especially during a vehicular attack. The base frame includes a plurality of parallel beams having a first and second plate, such that the first plate connects the distal ends of the plurality of beams and the second plate connects the proximate ends of the plurality of beams. Further, the base frame includes a first foundation foot and a second foundation foot, wherein the first foundation foot is connected to the first plate and the second foundation foot is connected to the second plate. The first foundation foot and the second foundation foot are adapted to extend outwardly from the first and second plates, respectively, so as to provide a larger foundation base for the base frame.

For adequate connection to the bollard, the base frame includes a first bollard plate and a second bollard plate, such that the first and second bollard plates are adapted to secure the lower portion of the bollard to the base frame. The first bollard plate is positioned on the top of the base frame and the second bollard plate is positioned on the bottom of the base frame, thereby sandwiching the base frame.

For added support and a stronger foundation, the base frame can include a plurality of studs that extend from each side of the base frame. The plurality of studs is adapted to bond with the concrete or other substance poured into the foundation during installation of the shallow mounted fixed vehicle barrier device. Further, the shallow mounted fixed vehicle barrier device can utilize rebar rods and rebar mats to assist in securing the shallow mounted fixed vehicle barrier device to the foundation. The rebar rods and rebar mats are of a particular size and installed in particular positions, in order to maximize the strength of the foundation.

The use of the base frame and rebar rods and mats allows the shallow mounted fixed vehicle barrier device to be adequately installed in a foundation having a depth of less than twelve inches. Accordingly, installation of the shallow mounted fixed vehicle barrier device does not intrude on infrastructure buried further below. Moreover, the shallow mounted fixed vehicle barrier device can be installed in many locations where traditional bollards could not be installed.

A principle object of the present invention is to provide a shallow mounted fixed vehicle barrier device that can be installed in a foundation having a depth of less than twelve inches.

Another object of the present invention is to provide a shallow mounted fixed vehicle barrier device having a bollard and, optionally, a bollard sleeve adapted to prevent vehicular access to a particular area or facility.

Still another object of the present invention is to provide a shallow mounted fixed vehicle barrier device having an aesthetically pleasing barrier design that can combine finishes and colors to match the architectural design of the facility being secured, thereby giving the engineers and architects, who design buildings with vehicular intrusion solutions, the ability to maintain the artistic design of the facility.

It is another object of the present invention to provide a shallow mounted fixed vehicle barrier device that comprises a base frame adapted to maintain the bollard in a fixed, passive position.

Yet another object of the present invention is to provide a shallow mounted fixed vehicle barrier device that adequately bonds with the concrete or other substance poured within the foundation, thereby adequately securing the bollard during a vehicular attack.

Another object of the present invention is to provide a shallow mounted fixed vehicle barrier device that eliminates the need for extensive site surveying and detailed engineering to allow a large number of bollards to be installed together.

Still another object of the present invention is to provide a shallow mounted fixed vehicle barrier device that meets and/or exceeds the crash test ratings set by the Department of State (DOS).

These and other objects, features and advantages of the present invention will become more apparent upon reading the following specification in conjunction with the accompanying drawings.

DETAILED DESCRIPTION OF THE PREFERRED EMBODIMENTS

Figure 1:
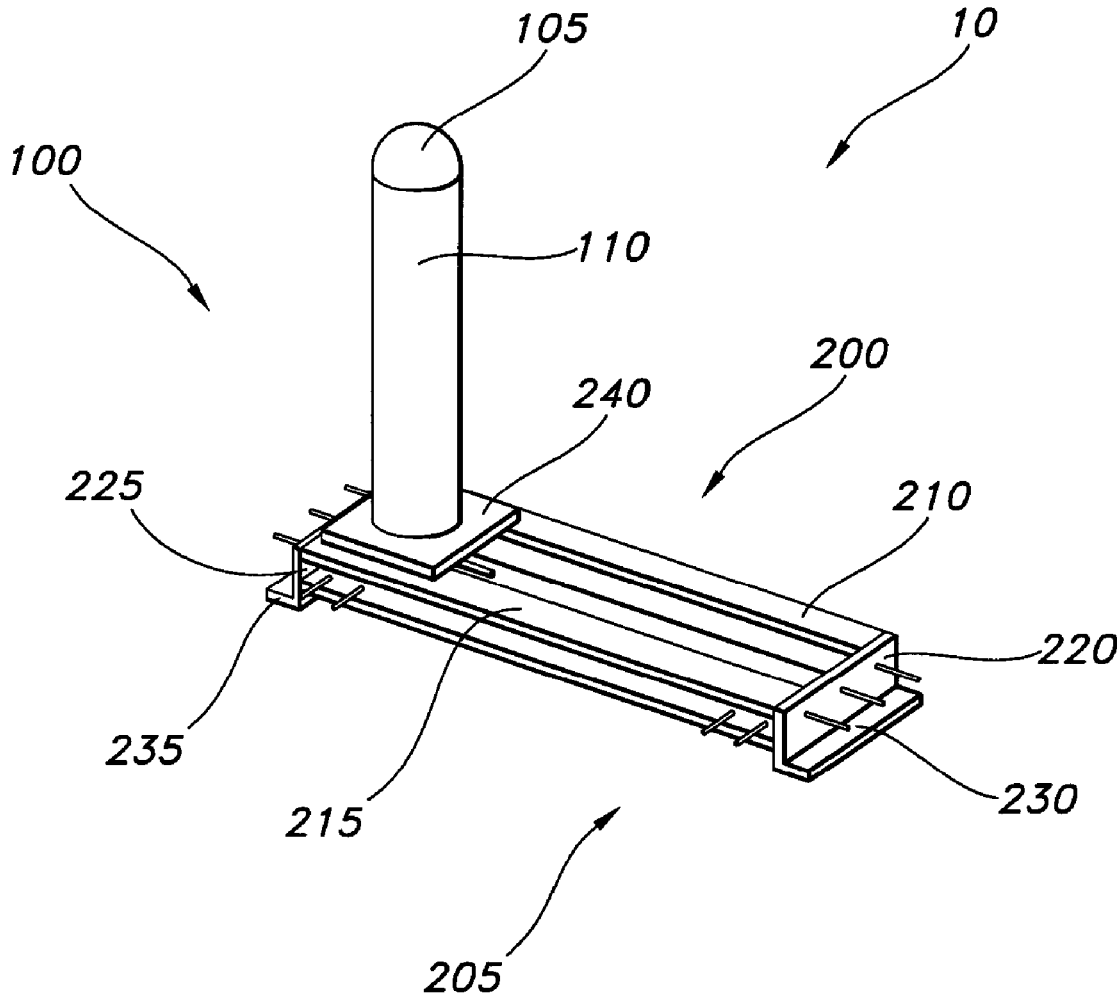
FIG. 1 illustrates an orthographic view of a shallow mounted fixed vehicle barrier device in accordance with preferred embodiments of the present invention.

Referring now in detail to the drawing figures, wherein like reference numerals represent like parts throughout the several views, a shallow mounted fixed vehicle barrier device 10 of FIG. 1 is designed for preventing vehicular access to a particular area. The shallow mounted fixed vehicle barrier device 10 provides an aesthetically pleasing barrier design, while eliminating multiple problems of previously designed barriers. The shallow mounted fixed vehicle barrier device 10 can be configured in various sizes and shapes conducive to blocking entrance to a restricted area and, more particularly, for preventing vehicular access to portions of a particular facility or a particular area.

As illustrated in FIG. 1, the shallow mounted fixed vehicle barrier device 10 comprises a barrier system 100 and a support system 200. The barrier system 100 has a passive (or fixed) position, such that vehicles cannot pass by or through the shallow mounted fixed vehicle barrier device 10. The support system 200 is adapted to maintain the barrier system 100 in the passive position and, thereby, prevent vehicular access to a particular facility or area secured by the shallow mounted fixed vehicle barrier device 10. Accordingly, the particular facility or area to be secured by the shallow mounted fixed vehicle barrier device 10 is never accessible to vehicles, as the barrier system 100 is always in the passive position (after installation).

The barrier system 100 of the shallow mounted fixed vehicle barrier device 10, as shown in FIG. 1, comprises a bollard 105 and, optionally, a bollard sleeve 110. When installed and during use, the bollard 105 is typically upright and substantially perpendicular to the ground, such that the top of the bollard 105 is at a predetermined height above the ground. The predetermined height of the bollard 105 is adequate enough to prevent vehicles from driving over the bollard 105 in an attempt to access the secure area protected by the shallow mounted fixed vehicle barrier device 10. Typically, the height of the bollard 105 is approximately thirty to forty inches above the ground. In a preferred embodiment of the present invention, the bollard 105 is approximately thirty-six inches above the ground. A predetermined portion of the bollard 105 is generally installed below the ground and is in communication with the support system 200.

In the passive position, the bollard 105 remains fixed in a substantially perpendicular position from the ground. As the purpose of the shallow mounted vehicle barrier device 10 is to prevent vehicular access to a predetermined area or facility, the bollard 105 should remain in the passive position, even after impact by a vehicle.

One skilled in the art will recognize that the bollard 105 can comprise various shapes and sizes, while still maintaining its intended purpose. Generally, the bollard 105 is a cylindrical tube made of a durable material. In one embodiment, the bollard 105 is an upright cylindrical tube constructed from heavy gauge steel pipe. Further, the bollard 105 can be of varying diameters depending on the desired crash rating capabilities. For example, the bollard 105 can have a diameter of approximately eight inches in order to meet most crash test ratings provided by the DOS.

The optional bollard sleeve 110 is adapted to substantially surround the portion of the bollard 105 above the ground. The bollard sleeve 110, therefore, can be decorative in nature, such that the bollard 105 can be covered with a bollard sleeve 110 customized to match the architectural setting of the surrounding area. Accordingly, the decorative bollard sleeve 110 can be designed in a variety of styles and colors in order to aesthetically correspond with the landscape of the facility or secured area.

Figure 2A:
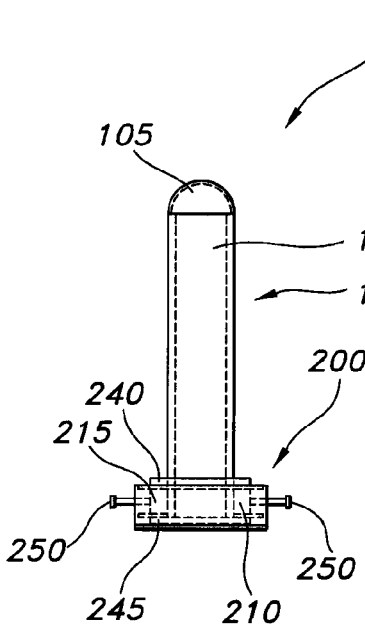
FIGS. 2A-C, collectively known as FIG. 2, illustrate three orthographic views of the shallow mounted fixed vehicle barrier device having a lateral steel foundation in accordance with preferred embodiments of the present invention.
Figure 2B:
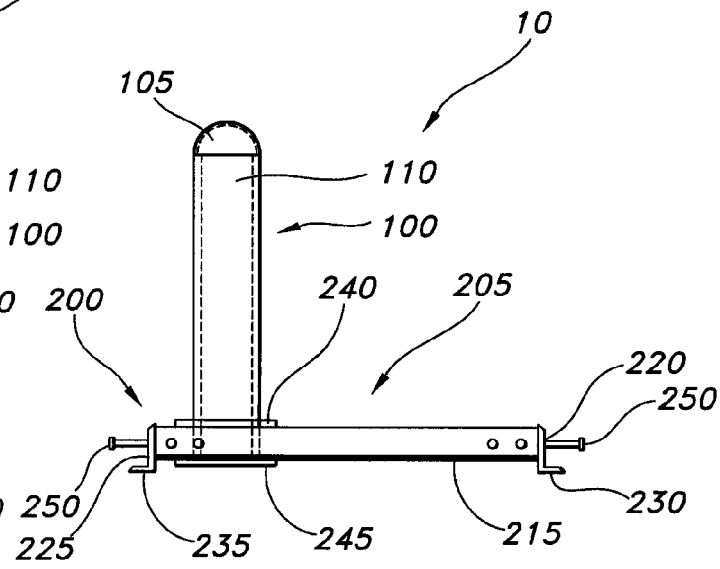
Figure 2C:
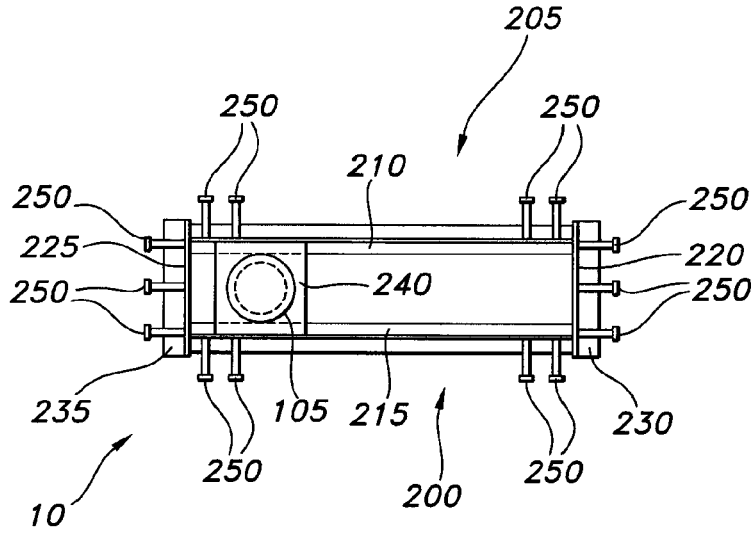
Figure 4:
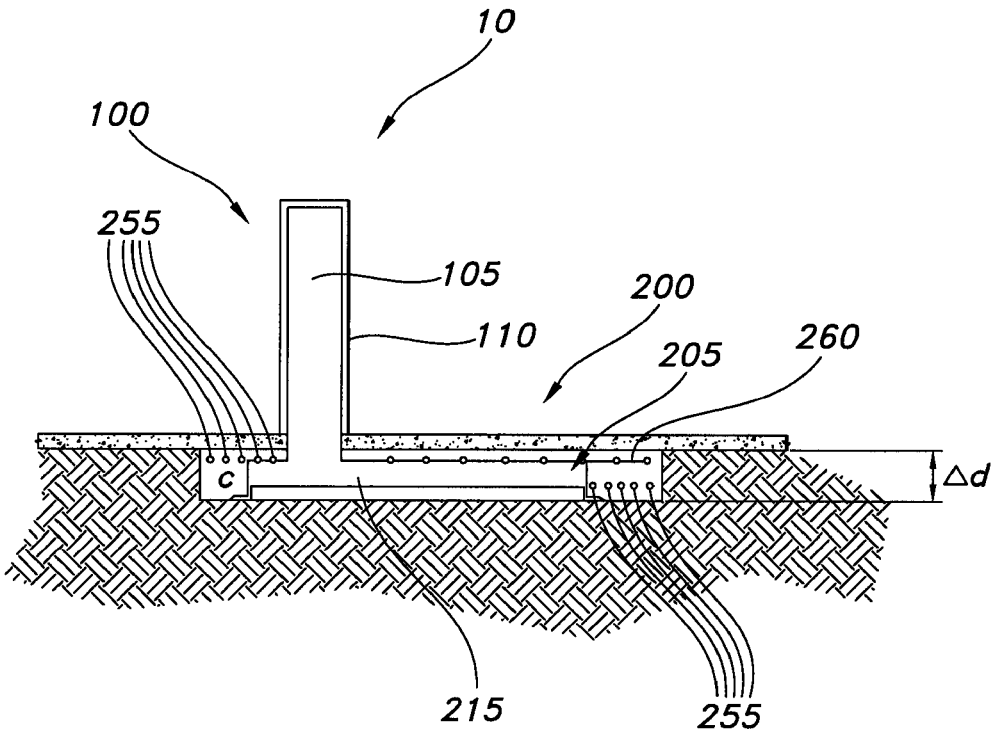
FIG. 4 illustrates a sectional view of the shallow mounted fixed vehicle barrier device utilizing rebar reinforcement in accordance with preferred embodiments of the present invention.

The support system 200, as shown in FIGS. 1, 2, and 4, comprises a base frame 205 anchored into the ground or other stationary object, whereby the base frame 205 is in communication with the bottom portion of the bollard 105 of the barrier system 100. The base frame 205 is adapted to maintain and secure the bollard 105 in a passive position, thereby preventing vehicular access to the secured area or facility.

The base frame 205 typically comprises a first beam 210, a second beam 215, a first beam plate 220, a second beam plate 225, a first foundation foot 230, a second foundation foot 235, a first bollard (barrier) plate 240, and a second bollard (barrier) plate 245. The first beam 210 is generally positioned evenly and substantially parallel to the second beam 215, such that the distance between the first beam 210 and the second beam 215 is slightly greater than the diameter of the bollard 105. For example, and not limitation, the first beam 210 and the second beam 215 can be steel I-beams having a general length of approximately forty-two to fifty-four inches. Generally, the length of the first beam 210 and the second beam 215 is slightly greater than the total height of the bollard 105. Further, the height of the first beam 210 and the second beam 215 is less than twelve inches. The first beam 210 and the second beam 215 generally have a length substantially equal to one and a half times the height of the bollard 105.

The first beam plate 220 is in communication with distal ends of the first beam 210 and the second beam 215, thereby indirectly connecting the distal end of the first beam 210 with the distal end of the second beam 215. The second beam plate 225 is in communication with proximate ends of the first beam 210 and the second beam 215, thereby indirectly connecting the proximate end of the first beam 210 with the proximate end of the second beam 215. As situated, the width of the first beam plate 220 and the second beam plate 225 is approximately equal to the width of the first beam 210, plus the width of the second beam 215, plus the distance between the first beam 210 and the second beam 215.

The first foundation foot 230 is in communication with the lower portion of the first beam plate 220, such that the first foundation foot 230 is positioned substantially perpendicular to the first beam plate 220. Further, the first foundation foot 230 extends outwardly away from the first beam plate 220. The first beam plate 220 and the first foundation foot 230, therefore, form an "L" shape. Similarly, the second foundation foot 235 is in communication with the lower portion of the second beam plate 225, such that the second foundation foot 235 is positioned substantially perpendicular to the second beam plate 225. Moreover, the second foundation foot 235 extends outwardly away from the second beam plate 225. The second beam plate 225 and the second foundation foot 235, therefore, form an "L" shape. The first foundation foot 230 and the second foundation foot 235 are adapted to permit concrete -C- (or other substance) to penetrate under the base frame 205 of the support system 200, in order to adequately anchor the base frame 205 into the prepared foundation.

In a preferred embodiment of the present invention, the bollard 105 is positioned approximately ten inches from the proximate ends of the first beam 210 and second beam 215. More specifically, the bollard 105 is generally positioned in between the first beam 210 and the second beam 215. The bollard 105 is secured to the base frame 205 via a first bollard plate 240 and a second bollard plate 245.

The first bollard plate 240 is in communication with a first lower portion of the bollard 105 and the top portions of the first beam 210 and the second beam 215. As the first bollard plate 240 can be fixed to the top of the first beam 210 and the top of the second beam 215, the bollard 105 is adequately mounted to the base frame 205. The second bollard plate 245 is in communication with a second lower portion of the bollard 105 and the bottom portions of the first beam 210 and the second beam 215. The second bollard plate 245 can be fixed to the bottom of the first beam 210 and the bottom of the second beam 215, thereby further securing the bollard 105 to the base frame 205. As situated, the first bollard plate 240 and the second pollard plate 245 forms a sandwich between the top and bottom of the first beam 210 and the second beam 215, while maintaining the connection of the bollard 105 to the base frame 205.

Figure 5A:
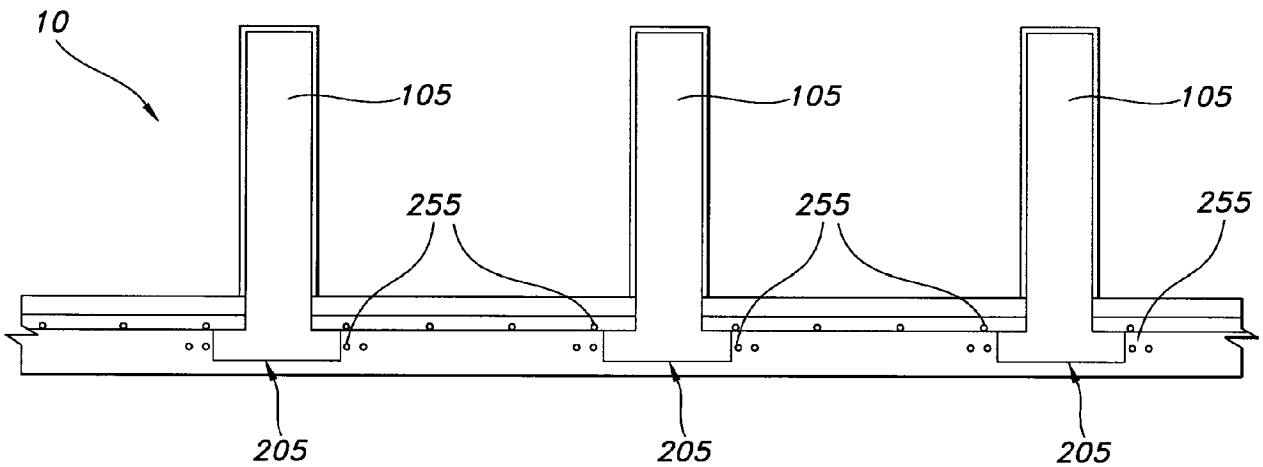
FIGS. 5A-5B, collectively known as FIG. 5, illustrate sectional views of the foundation for the shallow mounted fixed vehicle barrier device utilizing rebar reinforcement in accordance with preferred embodiments of the present invention.
Figure 5B:
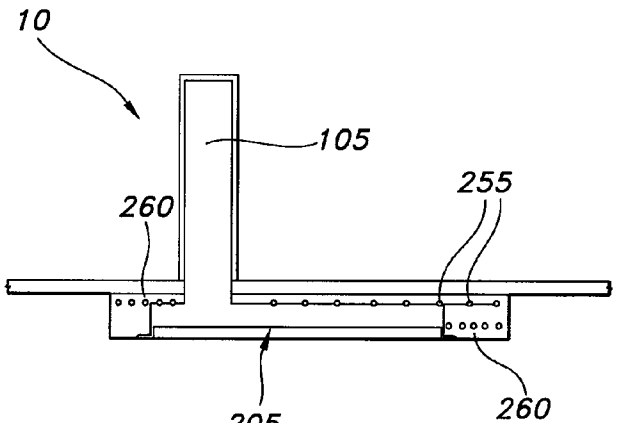

As shown in FIGS. 4 and 5A-B, the support system 200 of the shallow mounted fixed vehicle barrier device 10 is anchored in a foundation. The foundation is an integral part of the shallow mounted fixed vehicle barrier device 10 and is specifically designed to maximize the crash rating capabilities of the shallow mounted fixed vehicle barrier device 10. Typically, for a single shallow mounted fixed vehicle barrier device 10, the foundation is approximately five feet to six feet wide and approximately six to seven feet long (depending on the desired crash rating capabilities), and is approximately six to twelve inches in depth $\Delta d$. A foundation having a depth $\Delta d$ less than twelve inches ensures that the shallow mounted fixed vehicle barrier device 10 will not encounter various infrastructure or other building structures buried below.

The support system 200 is lowered into the foundation, such that the proximate end of the support system 200 (e.g., the end where the bollard 105 is mounted) faces the direction from which a potential vehicle attack would occur. For increased stability, the support system 200 can further comprise a plurality of studs 250, which extend outwardly from each side of the support system 200. The plurality of studs 250 is adapted to connect to the surrounding concrete -C- (or other substance) as it is poured into the foundation.

More specifically, a first set of the plurality of studs 250 can extend outwardly from the first beam plate 220, such that the first set of the plurality of studs 250 is substantially parallel with the first foundation foot 230. Similarly, a second set of the plurality of studs 250 can extend outwardly from the second beam plate 225, such that the second set of the plurality of studs 250 is substantially parallel with the second foundation foot 235.

A third set of the plurality of studs 250 can be positioned on the side of the first beam 210 near the proximate end of the first beam 210. The third set of the plurality of studs 250 extend outwardly from the first beam 210, such that the third set of the plurality of studs 250 is substantially perpendicular to the first beam 210. A fourth set of the plurality of studs 250 can be positioned on the side of the first beam 210 near the distal end of the first beam 210. The fourth set of the plurality of the studs 250 extend outwardly from the first beam 210, such that the fourth set of the plurality of the studs 250 is substantially perpendicular to the first beam 210.

A fifth set of the plurality of the studs can be positioned on the side of the second beam 215 near the proximate end of the second beam 215. The fifth set of the plurality of studs 250 extend outwardly from the second beam 215, such that the fifth set of the plurality of studs 250 is substantially perpendicular to the second beam 215. A sixth set of the plurality of studs 250 can be positioned on the side of the second beam 215 near the distal end of the second beam 215. The sixth set of the plurality of the studs 250 extend outwardly from the second beam 215, such that the sixth set of the plurality of the studs 250 is substantially perpendicular to the second beam 215.

For additional reinforcement, the foundation is constructed using rebar rods 255 (collectively rebar mats 260) at key locations within the foundation to connect the base frame 205 of the shallow mounted fixed vehicle barrier device 10 with the adjoining concrete -C- (or other substance) and, if applicable, adjacent bollards 105 and base frames. The placement and size of the rebar rods 255 is important in providing adequate reinforcement to the shallow mounted fixed vehicle barrier device 10. The rebar mats 260 are generally located laterally and horizontally at two different heights within the foundation.

For example, a first longitudinal rebar mat 260 can be positioned adjacent the bollard 105 and above the proximate end of the first and second beams 210, 215. Generally, there exists a clearance of approximately one and one-half inches between the top of the base frame 205 to the first rebar mat 260. A second longitudinal rebar mat 260 can be positioned adjacent the first beam plate 220, located at the distal end of the first and second beams 210, 215. There typically exists a clearance of approximately three inches between the bottom of the base frame 205 and the second rebar mat 260.

Additionally, in this example, transverse rebar rods 255 can be positioned in various positions around the first bollard plate 240 and second bollard plate 245, such that the rebar rods 255 are adjacent the outer sides of the first and second beams 210, 215. A third rebar mat 260 can be positioned on top of the base frame 205, such that the third rebar mat 260 extends from the bollard 105 towards and beyond the distal end of the first and second beams 210, 215, thereby covering the upper portion of the foundation.

To provide proper reinforcement, the rebar rods 255 and rebar mats 260 are generally made of #5 or greater rebar. One skilled in the art, however, will recognize that different sizes of rebar can be used with the present invention to achieve different levels of crash rating capabilities.

During installation, the shallow mounted fixed vehicle barrier device 10 is lowered into a foundation, as described above. After the rebar rods 255 and rebar mats 260 have been properly positioned, concrete -C- (or other substance) is poured into the foundation, thereby bounding with the rebar rods 255, rebar mats 260, and the plurality of studs 250 extending from the base frame 205. Further, concrete pavers may be installed over the foundation. If a vehicle crashes into the bollard 105 of the shallow mounted fixed vehicle barrier device 10, the support system 200 (including the base frame 205) maintains the bollard 105 in place, thereby preventing access to the secure area or facility. The present invention, therefore, provides a substantially effective, passive vehicle barrier, while utilizing a foundation with a very minimal depth $\Delta d$.

Figure 3:
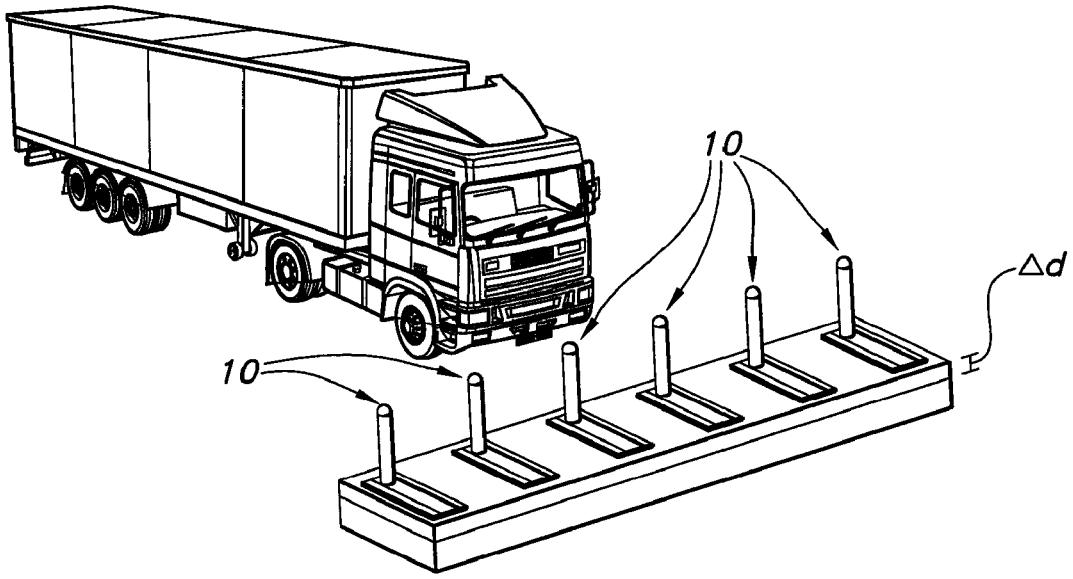
FIG. 3 illustrates a perspective view of a series of shallow mounted fixed vehicle barrier devices in accordance with preferred embodiments of the present invention.

As shown in FIG. 3, multiple shallow mounted fixed vehicle barrier devices 10 can be used in a series or group to secure the perimeter of a facility or area against vehicular intrusion. The fixed bollards 105 are typically installed approximately four feet from each other, such that the bollards 105 are placed in any opening large enough to allow a vehicle to enter. For example, several hundred of the shallow mounted fixed vehicle barrier devices 10 can be used to provide a perimeter protection solution. One skilled in the art will recognize that the use of multiple shallow mounted fixed vehicle barrier devices 10 in a variety of arrangements can be used within the scope of the present invention.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A shallow mounted fixed vehicle barrier device comprising:

a fixed barrier secured in a passive position, wherein the fixed barrier secured in the passive position prevents a vehicle from entering a predetermined location; and a base frame positioned within a foundation, the base frame comprising:

a first beam having a first end and a second end;

a second beam having a first end and a second end, wherein the second beam is positioned generally parallel with the first beam, such that the first end of the first beam and the first end of the second beam rigidly coupled to a lower end of the fixed barrier, a first barrier plate in communication with a first lower portion of the fixed barrier and positioned adjacent a top portion of the first beam and the second beam; and a second barrier plate in communication with a second lower portion of the fixed barrier and positioned adjacent a bottom portion of the first beam and the second beam, wherein the first barrier plate and the second barrier plate secure the fixed barrier to the base frame.

2. The shallow mounted fixed vehicle barrier device of claim 1, wherein the first beam is positioned a distance from the second beam, such that the distance is slightly greater than a width of the fixed barrier, and wherein the fixed barrier is positioned between the first beam and the second beam.

3. The shallow mounted fixed vehicle barrier device of claim 1, the base frame further comprising:

a first beam plate in communication with the first ends of the first beam and the second beam; and a second beam plate in communication with the second ends of the first beam and the second beam.

4. The shallow mounted fixed vehicle barrier device of claim 3, the base frame further comprising:

a first foundation foot in communication with a lower portion of the first beam plate, wherein the first foundation foot is positioned substantially perpendicular to the first beam plate so that the first foundation foot extends outwardly away from the first beam plate; and a second foundation foot in communication with a lower portion of the second beam plate, wherein the second foundation foot is positioned substantially perpendicular to the second beam plate so that the second foundation foot extends outwardly away from the second beam plate, wherein the first foundation foot and the second foundation foot are adapted to adequately anchor the base frame in the foundation.

5. The shallow mounted fixed vehicle barrier device of claim 3, the base frame further includes a plurality of studs extending outwardly from the base frame, such that the plurality of studs are adapted to bound with surrounding concrete of the foundation.

6. The shallow mounted fixed vehicle barrier device of claim 1, the foundation comprising a plurality of rebar rods in communication with the base frame, such that the plurality of rebar rods are adapted to bound the base frame with surrounding concrete of the foundation.

7. A shallow mounted fixed vehicle barrier apparatus comprising:

a stationary bollard fixed in a passive position, wherein the stationary bollard prevents vehicle access to a predetermined area when in the passive position;

a base frame coupled to the stationary bollard at a location proximate to a first end of the base frame such that a second end of the base frame extends away from the stationary bollard, wherein the base frame is receivable within a foundation and is adapted to maintain the stationary bollard in the passive position, the base frame comprising:

a first beam having a first end and a second end, wherein the first beam is positioned generally perpendicular with the stationary bollard;

a second beam having a first end and a second end, wherein the second beam is positioned generally parallel with the first beam;

a first beam plate in communication with the first ends of the first beam and the second beam;

a second beam plate in communication with the second ends of the first beam and the second beam;

a first foundation foot in communication with the first beam plate, wherein the first foundation foot is positioned generally perpendicular to the first beam plate and extends outwardly from the first beam plate;

a second foundation foot in communication with the second beam plate, wherein the second foundation foot is positioned generally perpendicular to the second beam plate and extends outwardly from the second beam plate;

a first bollard plate in communication with a first lower portion of the stationary bollard and positioned adjacent a top portion of the first beam and the second beam; and a second bollard plate in communication with a second lower portion of the stationary bollard and positioned adjacent a bottom portion of the first beam and the second beam.

8. The shallow mounted fixed vehicle barrier apparatus of claim 7, wherein the first foundation foot and the second foundation foot are adapted to adequately anchor the base frame in the foundation.

9. The shallow mounted fixed vehicle barrier apparatus of claim 7, wherein the first bollard plate and the second bollard plate secure the stationary bollard to the base frame.

10. The shallow mounted fixed vehicle barrier apparatus of claim 7, wherein the base frame further comprises a plurality of studs extending outwardly from the first beam, second beam, first beam plate, and second beam plate, such that the plurality of studs are adapted to bound with surrounding concrete of the foundation.

11. The shallow mounted fixed vehicle barrier apparatus of claim 7, wherein the base frame further comprises a plurality of rebar rods positioned within the foundation, such that the rebar rods assist in connecting the base frame with surrounding concrete of the foundation, thereby providing adequate reinforcement for maintaining the stationary bollard in the passive position.

12. A shallow mounted fixed vehicle barrier system comprising:

a bollard having a passive position, wherein the bollard prevents vehicle access to a predetermined area when in the passive position; and a base frame for maintaining the bollard in the passive position, the base frame comprising:

a first beam having a first end and a second end, wherein the first beam is positioned generally perpendicular with the bollard;

a second beam having a first end and a second end, wherein the second beam is positioned generally parallel with the first beam;

a first beam plate in communication with the first ends of the first beam and the second beam;

a second beam plate in communication with the second ends of the first beam and the second beam;

a first foundation foot in communication with the first beam plate, wherein the first foundation foot is positioned generally perpendicular to the first beam plate and extends outwardly from the first beam plate;

a second foundation foot in communication with the second beam plate, wherein the second foundation foot is positioned generally perpendicular to the second beam plate and extends outwardly from the second beam plate;

a first bollard plate in communication with a first lower portion of the bollard and positioned adjacent a top portion of the first beam and the second beam proximate to the first ends of the first beam and the second beam such that the second ends of the first beam and the second beam extend away from the first bollard plate; and a second bollard plate in communication with a second lower portion of the bollard and positioned adjacent a bottom portion of the first beam and the second beam proximate to the first ends of the first beam and the second beam such that the second ends of the first beam and the second beam extend away from the first bollard plate.

13. The shallow mounted fixed vehicle barrier apparatus of claim 12, wherein the base frame further comprises a plurality of studs extending outwardly from the first beam, second beam, first beam plate, and second beam plate, such that the plurality of studs are adapted to bound with surrounding concrete of the foundation.

14. The shallow mounted fixed vehicle barrier apparatus of claim 12, wherein the base frame further comprises a plurality of rebar rods positioned within the foundation, such that the rebar rods assist in connecting the base frame with surrounding concrete of the foundation, thereby providing adequate reinforcement for maintaining the bollard in the passive position.

15. The shallow mounted fixed vehicle barrier apparatus of claim 12, wherein the first foundation foot and the second foundation foot are adapted to adequately anchor the base frame in the foundation.

16. The shallow mounted fixed vehicle barrier apparatus of claim 12, wherein the first bollard plate and the second bollard plate secure the bollard to the base frame.

* * * * *